US006837774B2

(12) United States Patent
Hu et al.

(10) Patent No.: US 6,837,774 B2
(45) Date of Patent: Jan. 4, 2005

(54) LINEAR CHEMICAL MECHANICAL POLISHING APPARATUS EQUIPPED WITH PROGRAMMABLE PNEUMATIC SUPPORT PLATEN AND METHOD OF USING

(75) Inventors: Tien-Chen Hu, Ping-Pung (TW); Jih-Churng Twu, Chung-Ho (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 416 days.

(21) Appl. No.: 09/820,107

(22) Filed: Mar. 28, 2001

(65) Prior Publication Data

US 2002/0142704 A1 Oct. 3, 2002

(51) Int. Cl.[7] ..... B24B 49/00

(52) U.S. Cl. ..... 451/8; 451/5; 451/41; 451/285; 451/286; 451/287; 451/288; 451/289; 451/296; 451/299; 451/303; 451/307; 451/311

(58) Field of Search ..... 451/41, 285, 286, 451/287, 288, 289, 296, 299, 303, 307, 311, 5, 8, 6, 63, 456, 388, 364, 446, 490, 300

(56) References Cited

U.S. PATENT DOCUMENTS 5,916,012 A * 6/1999 Pant et al.
6,261,958 B1 * 7/2001 Crevasse et al.

* cited by examiner

*Primary Examiner*—Joseph J. Hail
*Assistant Examiner*—Shantese McDonald
(74) *Attorney, Agent, or Firm*—Tung & Associates

(57) ABSTRACT

A linear chemical mechanical polishing apparatus that is equipped with a programmable pneumatic support platen and a method for controlling the polishing profile on a wafer surface during a linear CMP process are disclosed. The programmable pneumatic support platen is positioned juxtaposed to a bottom surface of a continuous belt for the linear CMP apparatus and positioned corresponding to a position of the wafer carrier so as to force the polishing pad against the wafer surface to be polished. The support platen has a predetermined thickness, a plurality of apertures through the thickness and a plurality of openings in a top surface in fluid communication with a gas source through the plurality of apertures.

9 Claims, 4 Drawing Sheets

LINEAR CHEMICAL MECHANICAL POLISHING APPARATUS EQUIPPED WITH PROGRAMMABLE PNEUMATIC SUPPORT PLATEN AND METHOD OF USING

FIELD OF THE INVENTION

The present invention generally relates to a linear chemical mechanical polishing apparatus and a method of using and more particularly, relates to a linear chemical mechanical polishing apparatus equipped with a programmable pneumatic support plate and in a method of using such apparatus.

BACKGROUND OF THE INVENTION

In the fabrication of semiconductor devices from a silicon wafer, a variety of semiconductor processing equipment and tools are utilized. One of these processing tools is used for polishing thin, flat semiconductor wafers to obtain a planarized surface. A planarized surface is highly desirable on a shadow trench isolation (STI) layer, on an inter-layer dielectric (ILD) or on an inter-metal dielectric (IMD) layer which are frequently used in memory devices. The planarization process is important since it enables the use of a high resolution lithographic process to fabricate the next level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing or CMP. The process has been widely used on ILD or IMD layers in fabricating modern semiconductor devices. A CMP process is performed by using a rotating platen in combination with a pneumatically actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen with a resilient layer as an outer layer of the pad. The layers are typically made of a polymeric material such as polyurethane and may include a filler for controlling the dimensional stability of the layers. A polishing pad is typically made several times the diameter of a wafer in a conventional rotary CMP, while the wafer is kept off-center on the pad in order to prevent polishing a non-planar surface onto the wafer. The wafer itself is also rotated during the polishing process to prevent polishing a tapered profile onto the wafer surface. The axis or rotation of the wafer and the axis of rotation of the pad are deliberately not collinear, however, the two axes must be parallel. It is known that uniformity in wafer polishing by a CMP process is a function of pressure, velocity and concentration of the slurry used.

A CMP process is frequently used in the planarization of an ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 5000 Å and about 10,000 Å. The uniformity requirement for ILD or IMD polishing is very stringent since non-uniform dielectric films lead to poor lithography and resulting window etching or plug formation difficulties. The CMP process has also been applied to polishing metals, for instance, in tungsten plug formation and in embedded structures. A metal polishing process involves a polishing chemistry that is significantly different than that required for oxide polishing.

The important component needed in a CMP process is an automated rotating polishing platen and a wafer holder, which both exert a pressure on the wafer and rotate the wafer independently of the rotation of the platen. The polishing or the removal of surface layers is accomplished by a polishing slurry consisting mainly of colloidal silica suspended in deionized water or KOH solution. The slurry is frequently fed by an automatic slurry feeding system in order to ensure the uniform wetting of the polishing pad and the proper delivery and recovery of the slurry. For a high volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in controlling polishing rates and different locations on a wafer surface. Since the polishing rate applied to a wafer surface is generally proportional to the relative velocity of the polishing pad, the polishing rate at a specific point on the wafer surface depends on the distance from the axis of rotation. In other words, the polishing rate obtained at the edge portion of the wafer that is closest to the rotational axis of the polishing pad is less than the polishing rate obtained at the opposite edge of the wafer. Even though this is compensated by rotating the wafer surface during the polishing process such that a uniform average polishing rate can be obtained, the wafer surface, in general, is exposed to a variable polishing rate during the CMP process.

More recently, a new chemical mechanical polishing method has been developed in which the polishing pad is not moved in a rotational manner but instead, in a linear manner. It is therefor named as a linear chemical mechanical polishing process in which a polishing pad is moved in a linear manner in relation to a rotating wafer surface. The linear polishing method affords a uniform polishing rate across a wafer surface throughout a planarization process for uniformly removing a film player of the surface of a wafer. One added advantage of the linear CMP system is the simpler construction of the apparatus and therefore not only reducing the cost of the apparatus but also reduces the floor space required in a clean room environment.

A typical linear CMP apparatus 10 is shown in FIGS. 1A and 1B. The linear CMP apparatus 10 is utilized for polishing a semiconductor wafer 24, i.e. a silicon wafer for removing a film layer of either an insulating material or a wafer from the wafer surface. For instance, the film layer to be removed may include insulating materials such as silicon oxide, silicon nitrite or spin-on-glass material or a metal layer such as aluminum, copper or tungsten. Various other materials such as metal alloys or semi-conducting materials such as polysilicon may also be removed.

As shown in FIGS. 1A and 1B, the wafer 24 is mounted on a rotating platform, or wafer holder 18 which rotates at a predetermined speed. The major difference between the linear polisher 10 and a conventional CMP is that a continuous, or endless belt 12 is utilized instead of a rotating polishing pad. The belt 12 moves in a linear manner in respect to the rotational surface of the wafer 24. The linear belt 12 is mounted in a continuous manner over a pair of rollers 14 which are, in turn, driven by a motor means (not shown) at a pre-determined rotational speed. The rotational motion of the rollers 14 is transformed into a linear motion 26 in respect to the surface of the wafer 24. This is shown in FIG. 1B.

In the linear polisher 10, a polishing pad 30 is adhesively joined to the continuous belt 12 on its outer surface that faces the wafer 24. A polishing assembly 40 is thus formed by the continuous belt 12 and the polishing pad 30 glued thereto. As shown in FIG. 1A, a plurality of polishing pads 30 are utilized which are frequently supplied in rectangular-shaped pieces with a pressure sensitive layer coated on the back side.

The wafer platform 18 and the wafer 24 forms an assembly of a wafer carrier 28. The wafer 24 is normally held in position by a mechanical retainer, commonly known as a retaining ring 16, as shown in FIG. 1B. The major function of the retaining ring 16 is to fix the wafer in position in the wafer carrier 28 during the linear polishing process and thus preventing the wafer from moving horizontally as wafer 24 contacts the polishing pad 30. The wafer carrier 28 is normally operated in a rotational mode such that a more uniform polishing on wafer 24 can be achieved. To further improve the uniformity of linear polishing, a support housing 32 is utilized to provide support to support platen 22 during a polishing process. The support platen 22 provides a supporting platform for the underside of the continuous belt 12 to ensure that the polishing pad 30 makes sufficient contact with the surface of wafer 24 in order to achieve more uniform removal in the surface layer. Typically, the wafer carrier 28 is pressed downwardly against the continuous belt 12 and the polishing pad 30 at a predetermined force such that a suitable polishing rate on the surface of wafer 24 can be obtained. A desirable polishing rate on the wafer surface can therefore by obtained by suitably adjusting forces on the support housing 32, the wafer carrier 28, and the linear speed 26 of the polishing pad 30. A slurry dispenser 20 is further utilized to dispense a slurry solution 34.

In the conventional linear polisher 10, the polishing pads 30 are joined to the continuous belt 12 by adhesive means such as by a pressure sensitive. In a typical linear polisher, since the continuous belt 12 may have a length of about 240 cm, while the polishing pads 30 cannot be supplied in the form of a continuous manner, many pieces of the polishing pads 30 must be used. In other words, seam lines between adjacent polishing pads 30 must be formed when joined to the continuous belt 12. For instance, when the polishing pads are supplied in length of only about 30~40 cm, between five and seven pieces of the polishing pads must be utilized.

The linear chemical mechanical polishing method provides the advantages of a high belt speed, a low compression force on the sample and the flexibility of using either a hard pad or a soft pad. However, a good planarity is achieved by the linear CMP method at the expense of polishing uniformity across a wafer surface. The poor polishing uniformity across the wafer surface is caused by the pattern of voids or protrusions utilized on a polishing pad in linear CMP. This is shown in FIGS. 2A, 2B and 2C.

As shown in FIG. 2A, the polishing pad 30 may be formed of a pad body 42 which has a top surface 44 and a bottom surface 46. It should be noted that in FIG. 2A, only a section of a polishing pad 30 is shown. The top surface 44 of the pad body 42 is provided with a multiplicity of grooves 50, each having a predetermined width and depth. The depth of the grooves 50 is normally smaller than the thickness of the pad body 42. FIG. 2B shows a similar pad body 42 but is provided with a multiplicity of apertures 52, i.e. perforations through the pad body 42. The diameter of each aperture in the multiplicity of apertures 52 is essentially the same. In another configuration, as shown in FIG. 2C, the pad body 42 is provided with a multiplicity of protrusions 54, i.e. mesas with grooves 56 therein between. The multiplicity of protrusions 54 are formed to a pre-determined thickness, i.e. to less than 3 mm. The top surface 58 of the multiplicity of protrusions 54 contacts a wafer surface during the linear CMP process.

In the conventional polishing pad 30 shown in FIGS. 2A, 2B and 2C, the polishing rate on a wafer surface contacting the top surface 44 of the pad is different across the wafer surface. For instance, it was found that at near the center line 60 of the pad body 42, polishing rate obtained is lower than the polishing rate obtained at two edge portions 62,64. The varying polishing rates across the width of the polishing pad 30 therefore causes poor uniformity on a wafer surface being polished. When the surface grooves 52 are of the same width (FIG. 2A), the apertures 52 are of the same diameter (FIG. 2B), or when the protrusions 54 are of the same size (FIG. 2C), poor uniformity in the thickness removed from the wafer surface is observed.

It is therefore an object of the present invention to provide a linear chemical mechanical polishing apparatus that does not have the drawbacks or shortcomings of a conventional linear CMP apparatus.

It is another object of the present invention to provide a linear CMP apparatus for achieving improved polishing uniformity on a wafer surface.

It is a further object of the present invention to provide a linear CMP apparatus for achieving improved planarity and uniformity on a wafer surface.

It is another further object of the invention to provide a linear CMP apparatus that is equipped with a programmable pneumatic support plate for supporting a polishing pad and achieving improved polishing uniformity on a wafer surface.

It is still another object of the present invention to provide a linear CMP apparatus equipped with a pneumatic support platen for the polishing pad that is divided into at least three separate zones each controlling a plurality of openings arranged in concentric circles.

It is yet another object of the present invention to provide a linear CMP apparatus equipped with a pneumatic support platen wherein a plurality of pneumatic zones is controlled by a plurality of pressure detectors, a plurality of flow regulators and a process controller.

It is still another further object of the present invention to provide a method for controlling the polishing profile on a wafer surface during a linear CMP process by flowing a gas through a plurality of apertures in a support platen for the polishing pad and forcing an intimate contact between a wafer surface and the polishing pad.

It is yet another further object of the present invention to provide a method for controlling the polishing profile of a wafer surface during linear CMP by a plurality of pressure detectors, a plurality of flow regulators and a process controller for controlling a pneumatic force exerted by a support platen.

SUMMARY OF THE INVENTION

In accordance with the present invention, a linear chemical mechanical polishing apparatus equipped with a programmable pneumatic support platen and a method for using such apparatus are disclosed.

In a preferred embodiment, a linear chemical mechanical polishing apparatus equipped with a programmable pneumatic support platen is provided which includes a wafer carrier for holding and rotating a wafer mounted thereon with a first surface to be polished exposed and facing downwardly; a continuous belt for mounting a plurality of polishing pads thereon; a motor means for providing rotational motion in a predetermined direction of the continuous belt; and a support platen situated juxtaposed to a bottom surface of the continuous belt corresponding to a position of the wafer carrier so as to force the polishing pad against the first surface of the wafer, the support platen has a predetermined thickness, a plurality of apertures therethrough and a plurality of openings in a top surface in fluid communication with a gas flow through the plurality of apertures.

In the linear CMP apparatus equipped with a programmable pneumatic support platen, the plurality of openings in the top surface may be arranged in a plurality of concentric circles, or arranged in at least three concentric circles, or arranged in about six concentric circles. Each of the plurality of openings may have a diameter between about 0.1 mm and about 10 mm, or a diameter preferably between about 1 mm and about 5 mm. The plurality of openings may also have different diameters. The plurality of openings may be arranged in at least three concentric circles and controlled in at least three zones wherein each zone controlling a plurality of openings situated in the same concentric circle. The linear CMP apparatus may further include a pressure detector and a flow regulator for each of the at least three zones. The linear CMP apparatus may further include a process controller for detecting and regulating a pressure and a flow rate of the pressurized gas flow in each of the at least three zones.

The present invention is further directed to a method for controlling the polishing profile of a wafer surface during a linear CMP process which can be carried out by the operating steps of first providing a linear CMP apparatus that includes a wafer carrier for holding and rotating a wafer mounted thereon with a first surface to be polished exposed and facing downwardly. A continuous belt for mounting a plurality of polishing pads thereon; a motor means for providing rotational motion of the continuous belt; and a support platen situated juxtaposed to a bottom surface of the continuous belt corresponding to a position of the wafer carrier, the support platen may have a predetermined thickness, a plurality of apertures therethrough and a plurality of openings in a top surface in fluid communication with a gas source; rotating the continuous belt in a predetermined direction; engaging the first surface of the wafer to the polishing pad; and flowing a gas flow through the plurality of apertures and the plurality of openings and forcing an intimate contact between the first surface of the wafer and the polishing pad.

The method for controlling the polishing profile on a wafer surface during a linear CMP process may further include the step of providing a plurality of pressure detectors, a plurality of flow regulators and a process controller. The method may further include the step of dividing the plurality of openings in at least three zones with a pressure in each zone controlled independently. The method may further include the step of dividing the plurality of openings in at least three zones wherein each zone has been equipped within a pressure detector and a flow regulator for outputting a predetermined pressure.

The method for controlling the polishing profile on a wafer surface during a linear CMP process may further include the steps of detecting a pressure of gas flow through a preselected zone incorporating a preselected plurality of openings and sending a first signal to a process controller; comparing the first signal with a pre-stored value in the process controller and sending the second signal to a flow regulator responsive to the preselected zone; and altering the pressure of the gas flow responsive to the second signal until the first signal substantially equals to the pre-stored value in the process controller. The method may further include the step of flowing a gas flow of air or nitrogen through the plurality of apertures and the plurality of openings, or the step of dividing the plurality of openings in at least three zones wherein each zone being arranged in a concentric circle. The method may further include the step of dividing the plurality of openings in about six zones wherein each zone being arranged in a concentric circle.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a linear chemical mechanical polishing apparatus that is equipped with a programmable pneumatic support platen. The present invention further discloses a method for controlling the polishing profile on a wafer surface during a linear chemical mechanical polishing process.

The linear CMP apparatus includes a wafer carrier, a continuous belt, a plurality of polishing pads mounted on the belt, a motor means for rotating the belt, and a support platen mounted juxtaposed to a bottom surface of the belt. The support platen has a predetermined thickness, a plurality of apertures through the thickness and a plurality of openings in a top surface in fluid communication with a gas source through the plurality of apertures. The plurality of openings in the top surface of the support platen may be arranged in a plurality of concentric circles, such as in at least three concentric circles. The plurality of openings arranged in the at least three concentric circles may be controlled in at least three zones with each zone controlling a plurality of openings in the same concentric circle. Each of the at least three zones may be equipped with a pressure detector and a flow regulator. The apparatus may further include a process controller, or a data acquisition system for detecting and regulating a pressure and a flow rate of the gas flow in each of the at least three zones.

The present invention further discloses a method for controlling the polishing profile on a wafer surface during a linear CMP process which is carried out by the steps of first providing a linear CMP apparatus that incorporates a support platen having a predetermined thickness, a plurality of apertures through the thickness and a plurality of openings in a top surface in fluid communication with a gas source; then rotating the continuous belt in a predetermined direction while engaging a first surface of the wafer to the polishing pad mounted on the belt. A gas flow is flown through the plurality of apertures and the plurality of openings enforcing an intimate contact between the first surface of the wafer and the polishing pad.

The method for controlling the polishing profile on the wafer surface during linear CMP may further include the steps of detecting a pressure of gas flow through a preselected zone incorporating a preselected plurality of openings and sending a first signal to a process controller, then comparing the first signal with a pre-stored value in the process controller and sending a second signal to a flow regulator responsive to the preselected zone, and altering the pressure of the gas flow responsive to the second signal until the first signal substantially equals to the pre-stored value in the process controller.

Figure 1A:
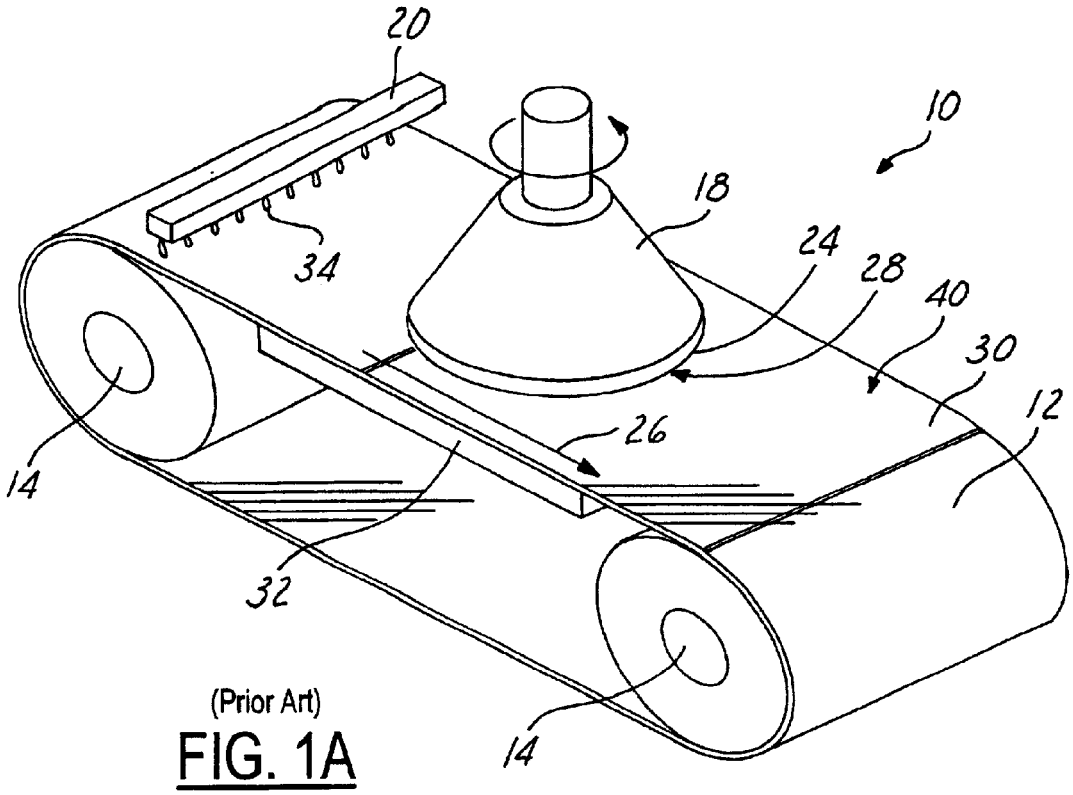
(Prior Art) FIG. 1A
FIG. 1A is a perspective view of a conventional linear chemical mechanical polishing apparatus utilizing a continuous belt.
Figure 1B:
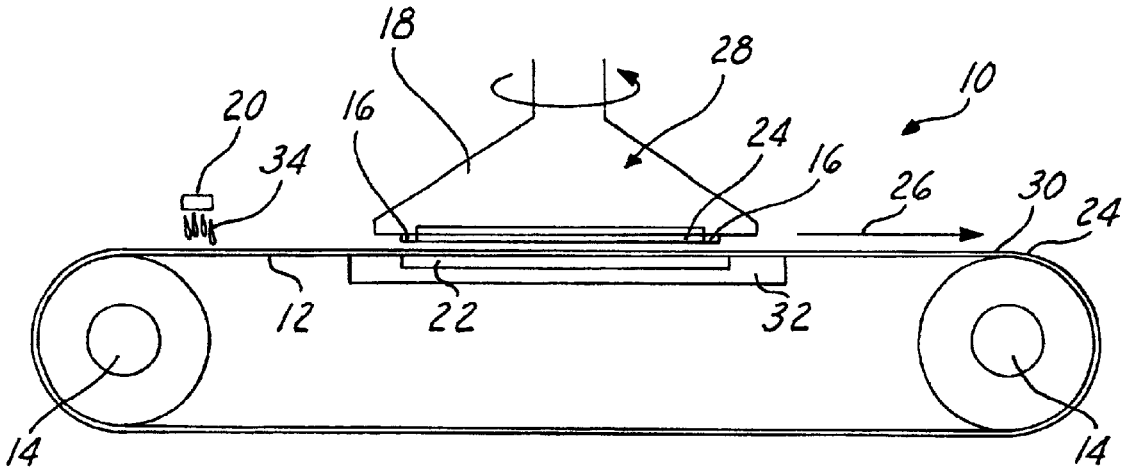
(Prior Art) FIG. 1B
FIG. 1B is a perspective view of a conventional linear chemical mechanical polishing apparatus of FIG. 1A.
Figure 2A:
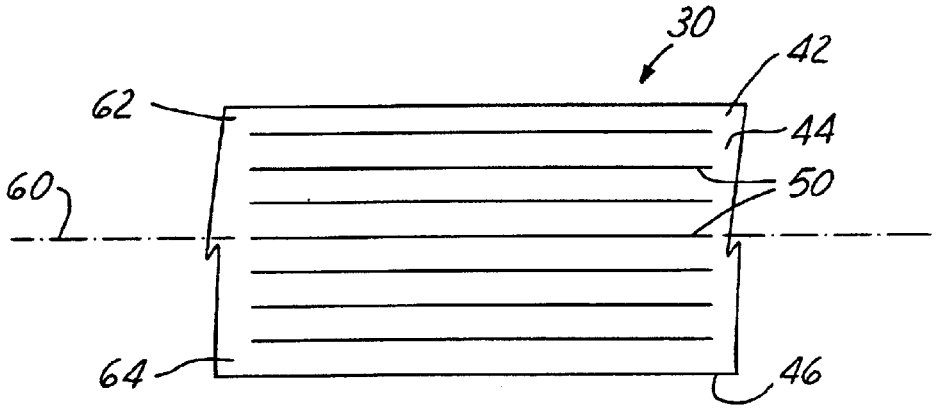
(Prior Art) FIG. 2A
FIG. 2A is a plane view of a section of a conventional polishing pad with a multiplicity of grooves formed in a top surface.
Figure 2B:
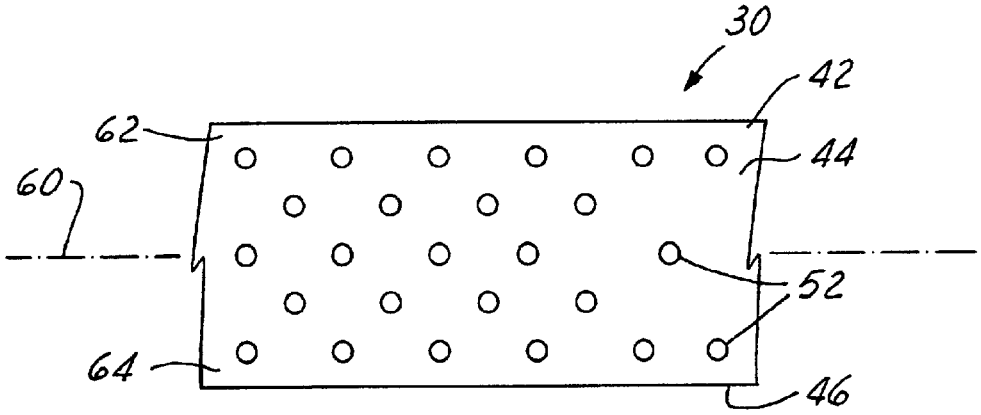
(Prior Art) FIG. 2B
FIG. 2B is a plane view of a section of a conventional polishing pad with a multiplicity of apertures formed through the pad.
Figure 2C:
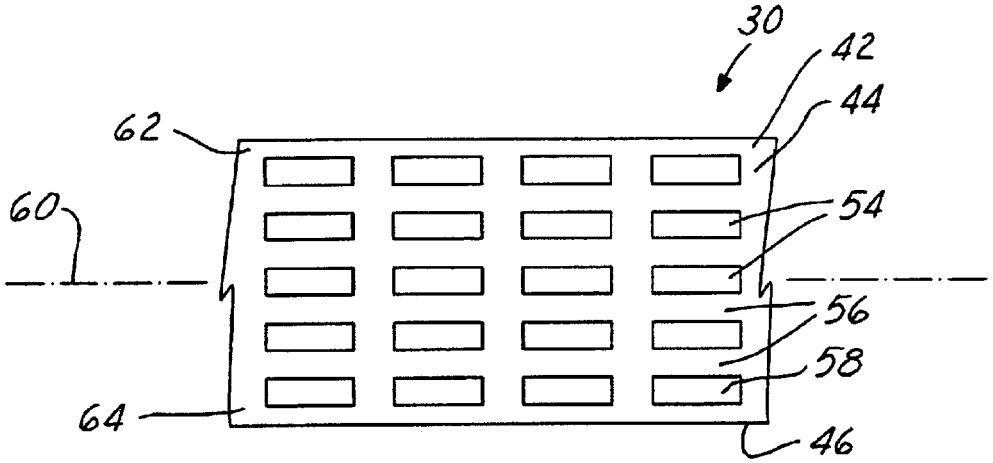
(Prior Art) FIG. 2C
FIG. 2C is a plane view of a section of a conventional polishing pad with a multiplicity of protrusions formed on the pads surface.
Figure 3:
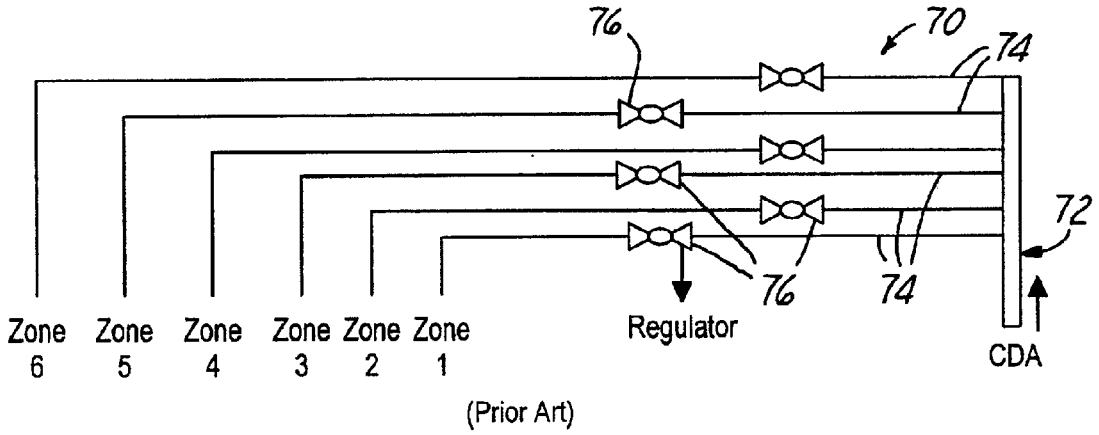
FIG. 3 is a schematic showing a manual flow controller for a conventional support platen equipped with gas flow apertures.

Referring now to FIG. 3, wherein a schematic of a conventional flow control system 70 is shown. The flow control system incorporates a gas flow input conduit 72 and a plurality of gas feed conduits 74 each controlled by a flow regulator 76. The flow regulators 76 are manually controlled by a machine operator prior to the start of a linear CMP process based on previous operating experience, i.e., by a trial and error method. A clean dry air (CDA) source is fed into the gas input conduit 72 as the pressure source for the continuous belt. The manually adjusted flow control system 70 is awkward to operate since the operator can only make adjustment based on prior measurements obtained on polished wafer surfaces.

Figure 4:
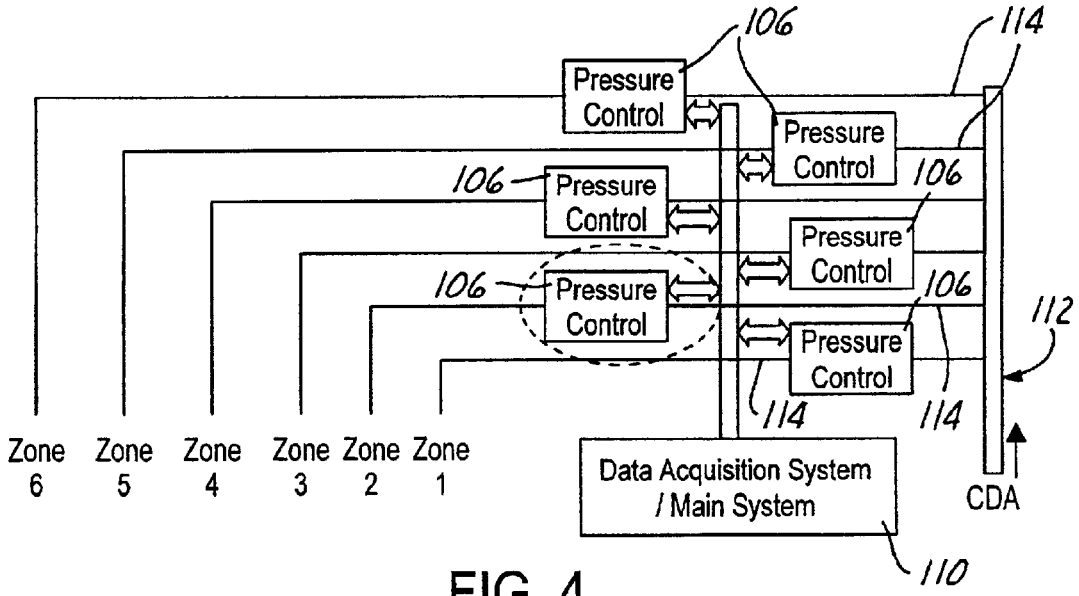
FIG. 4 is a schematic showing the present convention feed-back flow control system equipped with a process controller.
Figure 4A:
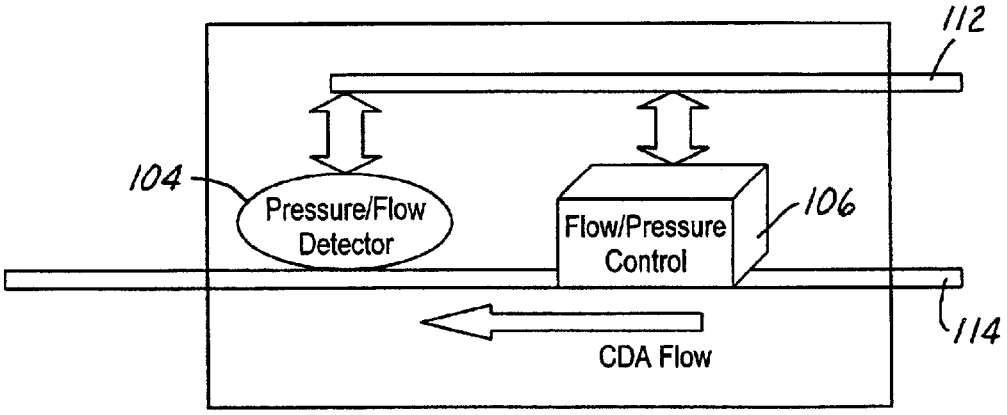
FIG. 4A is a detailed view of the pressure controller and the pressure indicator for a single zone control shown in FIG. 4.
Figure 5A:
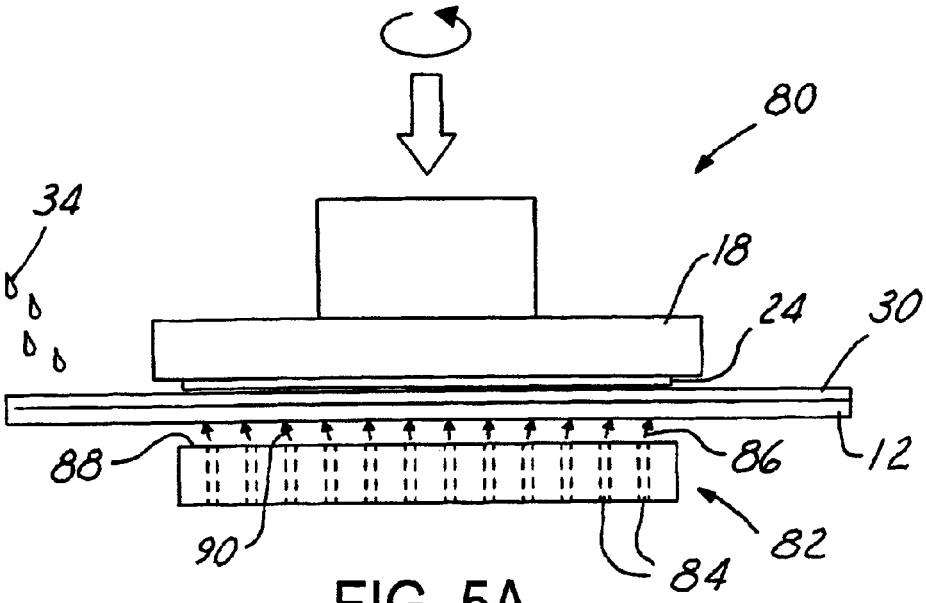
FIG. 5A is a cross-sectional view of the present invention linear CMP apparatus equipped with the programmable pneumatic support platen.
Figure 5B:
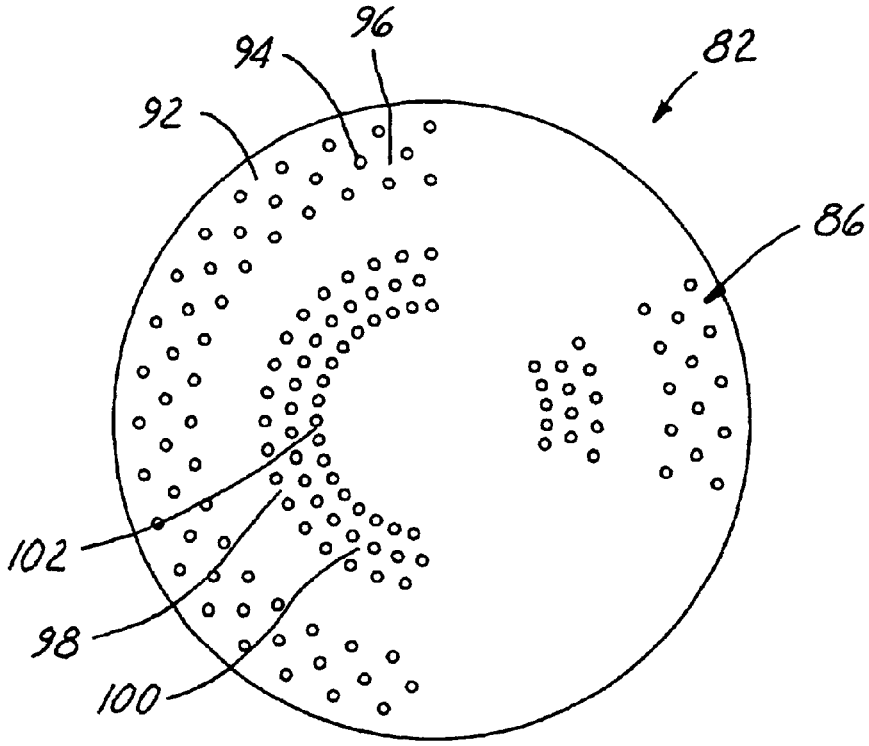
FIG. 5B is a plane view of the present invention pneumatic support platen of FIG. 5A.

FIGS. 4 and 4A illustrate the present invention flow control system for the programmable pneumatic support platen shown in FIGS. 5A and 5B. Referring initially to FIG. 5A wherein a cross-sectional view of a present invention linear CMP apparatus 80 equipped with a programmable pneumatic support platen 82 is shown. A wafer 24 is carried on the wafer platform 18 while being pressed down onto a top surface of the polishing pad 30 which is mounted on a continuous belt 12. It should be noted that in FIG. 5A, only a section of the continuous belt 12 and the polishing pad 30 is shown for simplicity reasons. A slurry solution 34 is dispensed onto a top surface of the polishing pad 30 for conducting the CMP process.

Juxtaposed to a bottom surface of the continuous belt 12, a present invention programmable pneumatic support platen 82 is positioned. The support platen 82 is formed with a plurality of apertures 84 therethrough each leading to one of a plurality of openings 86 in a top surface 88 of the support platen 82. A gas flow 90 of either a clean dry air (CDA) or a nitrogen from the plurality of openings 86 provides support to the polishing pad 30 and thus enabling the polishing pad 30 to intimately engage the wafer 24.

A plane view of the present invention support platen 82 is shown in FIG. 5B. It is seen that the plurality of openings 86 is arranged in concentric circles, for instance, in six concentric circles shown in FIG. 5B. To carry out the present invention novel method, the plurality of openings 86 on each of the concentric circles forms a separate zone of control for the pneumatic pressure. As shown in FIG. 5B, the six pneumatic pressure zones are shown as, from the outermost concentric circle, zone 92, zone 94, zone 96, zone 98, zone 100 and zone 102. It should be noted that, for simplicity reasons, not all the openings 86 are shown for each of the six pneumatically controlled zones. Each of the plurality of openings 86 may have a diameter between about 0.1 mm and about 10 mm, and preferably a diameter between about 1 mm and about 5 mm, and most preferably between about 2 mm and about 4 mm. The word "about" used in this writing indicates a range of value of ±10% of the average value given.

Each of the pneumatic pressure controlled zones is further equipped with a pressure detector 104 and a flow regulator 106 which are connected to a central process controller, or a data acquisition system 110. These are shown in FIGS. 4 and 4A.

As shown in FIG. 4, the gas source of clean dry air is fed into a gas input conduit 112 for feeding a gas pressure into gas conduits 114 for each of the six zones. In operation, a pressure of a gas flow through a preselected zone that incorporates a preselected plurality of openings 86 is first detected, a first signal is generated accordingly and sent to the process controller 110. The first signal is then compared to a pre-stored value in the process controller 110 and subsequently, the controller sends a second signal to a flow regulator 106 responsive to the preselected zone. The pressure of the gas flow is then altered responsive to the second signal until the first signal obtained is substantially equal to the pre-stored value in the process controller 110.

The present invention linear chemical mechanical polishing apparatus equipped with a programmable pneumatic support platen and a method for controlling the polishing profile on a wafer surface during a linear CMP process has therefore been amply described in the above description and in the appended drawings of FIGS. 4, 4A, 5, 5A and 5B.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A linear chemical mechanical polishing apparatus equipped with a programmable pneumatic support platen comprising:

a wafer carrier for holding and rotating a wafer mounted thereon with a first surface to be polished exposed and facing downwardly;

a continuous belt for mounting a plurality of polishing pads thereon;

a motor means for providing rotational motion in a predetermined direction of said continuous belt; and a support platen situated juxtaposed to a bottom surface of said continuous belt corresponding to a position of said wafer carrier so as to force said polishing pad against said first surface of the wafer, said support platen having a predetermined thickness, a plurality of apertures therethrough and a plurality of openings in a top surface in fluid communication with gas source through said plurality of apertures, said plurality of openings having different diameters.

2. A linear chemical mechanical polishing apparatus equipped with a programmable pneumatic support platen according to claim 1, wherein said plurality of openings in said top surface being arranged in a plurality of concentric circles.

3. A linear chemical mechanical polishing apparatus equipped with a programmable pneumatic support platen according to claim 1, wherein said plurality of openings in said top surface being arranged in at least three concentric circles.

4. A linear chemical mechanical polishing apparatus equipped with a programmable pneumatic support platen according to claim 3, wherein said plurality of openings arranged in at least three concentric circles being controlled in at least three zones with each zone controlling a plurality of openings in the same concentric circle.

5. A linear chemical mechanical polishing apparatus equipped with a programmable pneumatic support platen according to claim 4 further comprising a pressure detector and a flow regulator for each of said at least three zones.

6. A linear chemical mechanical polishing apparatus equipped with a programmable pneumatic support platen according to claim 4 further comprising a process controller for detecting and regulating a pressure and a flow rate of said gas flow in each of said at least three zones.

7. A linear chemical mechanical polishing apparatus equipped with a programmable pneumatic support platen according to claim 1, wherein said plurality of openings in said top surface being arranged in about six concentric circles.

8. A linear chemical mechanical polishing apparatus equipped with a programmable pneumatic support platen according to claim 1, wherein each of said plurality of openings having a diameter between about 0.1 mm and about 10 m.

9. A linear chemical mechanical polishing apparatus equipped with a programmable pneumatic support platen according to claim 1, wherein each of said plurality of openings having a diameter preferably between about 1 mm and about 5 mm.

* * * * *